US005335479A

United States Patent [19]

Lemke et al.

[11] Patent Number: 5,335,479

[45] Date of Patent: Aug. 9, 1994

[54] METHOD FOR STERILIZING A PACKAGING MACHINE, AND APPARATUS FOR PERFORMING THE METHOD

[75] Inventors: Kuno Lemke, Bietigheim-Bissingen; Guenther Voegele, Schoenaich; Harro Stehle, Ludwigsburg, all of Fed. Rep. of Germany

[73] Assignee: Robert Bosch GmbH, Stuttgart, Fed. Rep. of Germany

[21] Appl. No.: 19,484

[22] Filed: Feb. 19, 1993

[30] Foreign Application Priority Data

Feb. 25, 1992 [DE] Fed. Rep. of Germany ..... 4205655

[51] Int. Cl.[5] ..... B65B 55/00; B65B 39/00; B65B 3/02

[52] U.S. Cl. ..... 53/426; 53/451; 53/551

[58] Field of Search ..... 53/426, 425, 451, 450, 53/551, 552, 550; 422/905; 141/92, 91, 90, 89, 85; 134/22.12, 22.11, 22.1

[56] References Cited

U.S. PATENT DOCUMENTS

| | | | |
|---|---|---|---|
| 2,918,770 | 3/1958 | Stocker | 53/167 X |
| 3,299,603 | 1/1967 | Shaw | 53/426 |
| 3,912,535 | 10/1975 | Rauser | 134/22 C |
| 4,099,914 | 7/1978 | Gustafsson et al. | 53/426 |
| 4,524,563 | 6/1985 | Sassi | 141/91 X |
| 4,784,697 | 11/1988 | Bordini | 134/22.15 |
| 4,910,942 | 3/1990 | Dunn et al. | 53/425 |
| 5,044,140 | 9/1991 | Iwano et al. | 141/91 X |

FOREIGN PATENT DOCUMENTS 0232943 8/1987 European Pat. Off. ..... B65B 55/02

*Primary Examiner*—James F. Coan

*Attorney, Agent, or Firm*—Edwin E. Greigg; Ronald E. Greigg

[57] ABSTRACT

A bag package making machine that operates aseptically and in which a product is filled into a tube of packaging material and bag packages are partitioned off from that tube, the parts that come into contact with the packaging material and the product are sterilized, before filling operation begins, by passing a sterilizing agent through the filling tube and the bag forming part. For passing a sterilizing agent through the filling tube, a cup-shaped connecting element, which is enclosed by the packaging material tube, is connected to the outlet of the filling tube. Toward the end of the sterilizing phase, the filling tube and the connecting element are moved apart from one another, and the part of the packaging material tube surrounding these parts is sealed off between the connecting element and the filling tube and severed, so that the filling tube end remains in the closed end portion of the tube of packaging material which continues in a sterilized condition.

7 Claims, 4 Drawing Sheets

METHOD FOR STERILIZING A PACKAGING MACHINE, AND APPARATUS FOR PERFORMING THE METHOD

BACKGROUND OF THE INVENTION

The invention is based on a method for sterilizing product-carrying parts of a packaging machine, as generically defined hereinafter.

In packaging systems for aseptic package filling, parts that come into contact with the filling product or with the packaging material must not come into contact with unsterile articles or the ambient air again after the sterilizing phase that precedes the filling phase, so as to avoid reinfection. In a method known from EP A 232 943, which is performed in a packaging machine with two coaxial filling tubes, this requirement is met by using the inner filling tube to deliver the sterilizing agent, such as steam, and the outer filling tube to remove it; a connecting plate inserted into the outlet opening of the outer filling tube diverts the sterilizing agent, flowing in through the inner filling tube, into the protruding outer filling tube. After sterilization of the filling tubes and after a support cap for the connecting plate has been removed, the tube of packaging material is slipped over the filling tube ends and its end is closed with a sealed seam. The connecting plate is then pushed out of the opening of the outer filling tube into the end portion of the tube of packaging material, by a valve rod that passes through the inner filling tube; the connecting plate is sealed in at that end of the tube of packaging material, and at the same time a new end portion of tubular packaging material is formed with a sealed seam. After the partitioned-off end portion of the tube of packaging material has been severed from the remainder of the tube of packaging material, then the tubular end segment, which surrounds the filling tubes, and the outer walls of the filling tubes are acted upon by a sterilizing agent for a predetermined length of time, and the filling operation is then begun.

A disadvantage of this known method is that performing it requires two coaxial filling tubes and one externally actuatable rod for pushing off the connecting plate. There is a need for a sterilizing method for packaging machines of the type referred to at the outset that has only one filling tube that enters the tube of packaging material.

OBJECT AND SUMMARY OF THE INVENTION

The method of the invention as defined herein has an advantage that when only a single filling tube is provided, the surface area to be sterilized is small, while the larger flow cross section makes better cleaning possible. The connecting element can also be removed without having to enter the sterile space of the filling tube.

An apparatus in a packaging machine as defined by the method has the advantage that is requires only a few, uncomplicated parts and is also very simple to operate and maintain.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
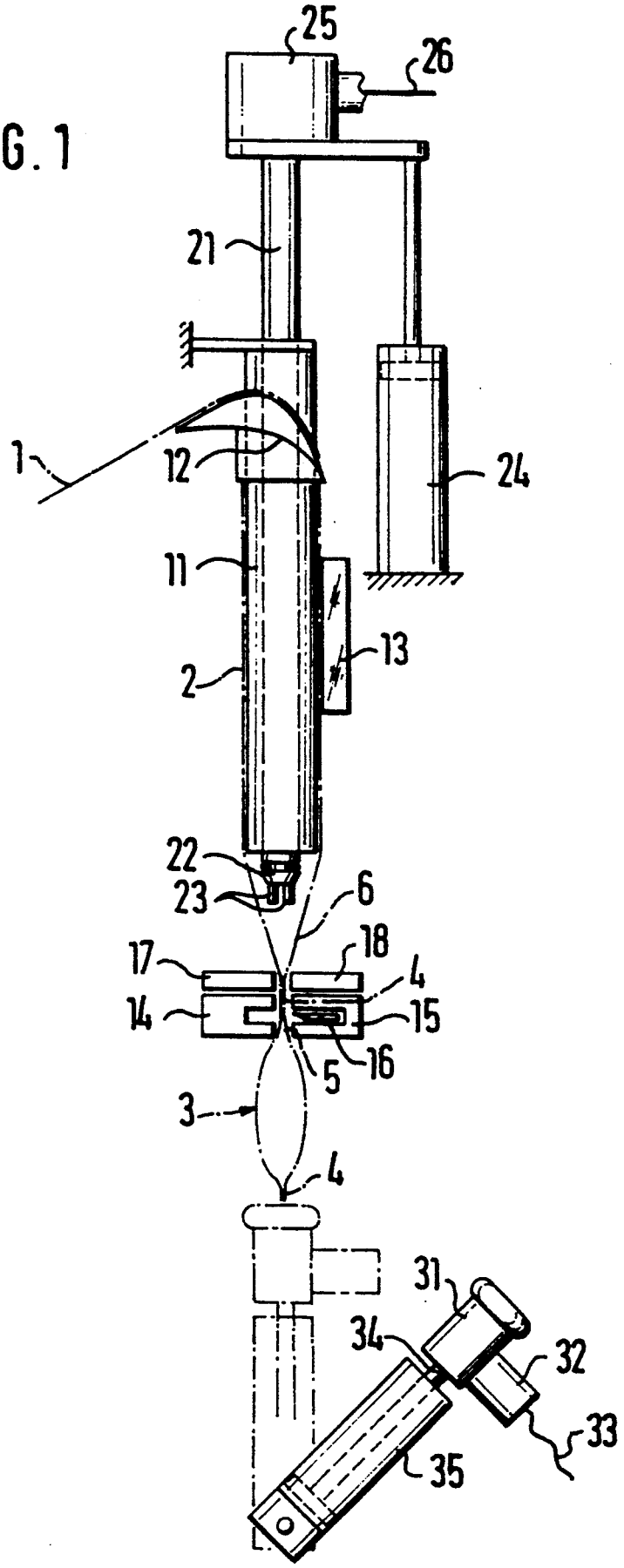
FIG. 1 shows a vertical tubular bag making machine in a simplified side view.

A packaging machine in which a liquid product is aseptically packed in bag packages 3 has a forming tube 11 and a forming shoulder 12 surrounding it, over which a flat sheet 1 of packaging material is drawn and formed around the forming tube 11 to make a tube 2 of packaging material; the abutting edges of the sheet 1 are joined with a lengthwise seam sealing device 13. The bottom end of the tube 2 is closed by a transverse bottom seam 4, and a quantity of the product is introduced into the open end portion 6. To form individual bag packages 3, the end portion 6 is pressed together at a predetermined level above its lower end by a transverse sealing device with two sealing jaws 14, 15 that can be moved toward one another, making a top seam 5 on the upper end of the end portion 6 and a bottom seam 4 on the lower end of the new end portion of the next bag. The finished bag package 3 is cut apart with a knife 16 between the bottom seam 4 and the top seam 5. The sealing jaws 14, 15 are movable toward one another and up and down by the length of one bag package, so that after grasping the tube 2, they form a top seam 5 and a bottom seam 4 of the next bag and then advance the tube 2 by the length of one bag at a time.

The product to be packed is introduced into the end portion 6 of the tube 2 through a filling tube 21, which axially penetrates the forming tube 11 and has a fill head 22 with a plurality of fill nozzles 23 on its lower end, serving as an outlet. The filling tube 21 is axially displaceable in the forming tube 11 and is moved up and down by a linear drive mechanism, such as a pneumatic cylinder 24, so that the end of the fill nozzles 23 during filling protrudes below the level of the product in the end portion 6 of the tube of packaging material.

A valve 25 located at the upper end of the filling tube 21 connects the filling tube 21 to a feed line 26 and meters the product incrementally during the filling operation.

Figure 2:
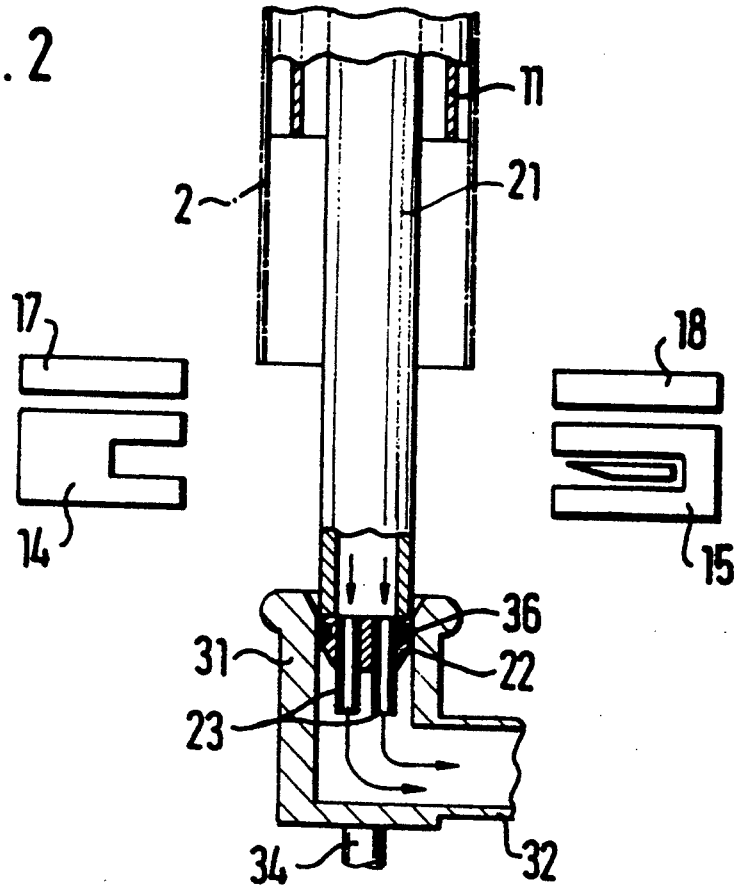
FIGS. 2–6 show the filling and closing region of the tubular bag making machine of FIG. 1 in various method steps, on a larger scale, seen in side view and partly in section.

Before the filling operation is begin, the parts of the packaging machine that come into contact with the product and the inside of the tube 2 of packaging material, particularly the filling tube 21, are sterilized; in the process, care must be taken that these parts not be allowed to come in contact with the ambient atmosphere between the sterilizing phase and the filling phase. To that end, a connecting element in the form of a cup 31 with an opening 32 is provided in the packaging machine below the sealing jaws 14, 15 and is connected to a drain 33. The cup 31 is mounted on a piston rod 34 of a pneumatic cylinder 35, which can be swiveled from a position of repose, in which it is swiveled out of the way, into axial alignment with the filling tube 21. In the aligned position, the cup 23 is displaced upward into an upper position and the filling tube 21 is displaced downward, so that the filling head 22 plunges sealingly into the opening of the cup 31, the cup 31 being located below the closing plane of the sealing jaws 14, 15 (see FIG. 2). The sealed engagement of the filling tube end or of the filling head 22 in the cup 31 is reinforced by a sealing ring 36 in a groove in the filling head 22 or in the cup 31. In this engaged position, a cleaning agent, first, and then for a predetermined period of time a sterilizing agent, preferably steam, are carried through the feed line 26, the valve 25 and the filling tube 21, sterilizing the inside surfaces of these parts. The sterilizing agent that emerges from the filling nozzles 23 is caught by the cup 31 and removed through its opening 32 into the drain 33.

Figure 3:
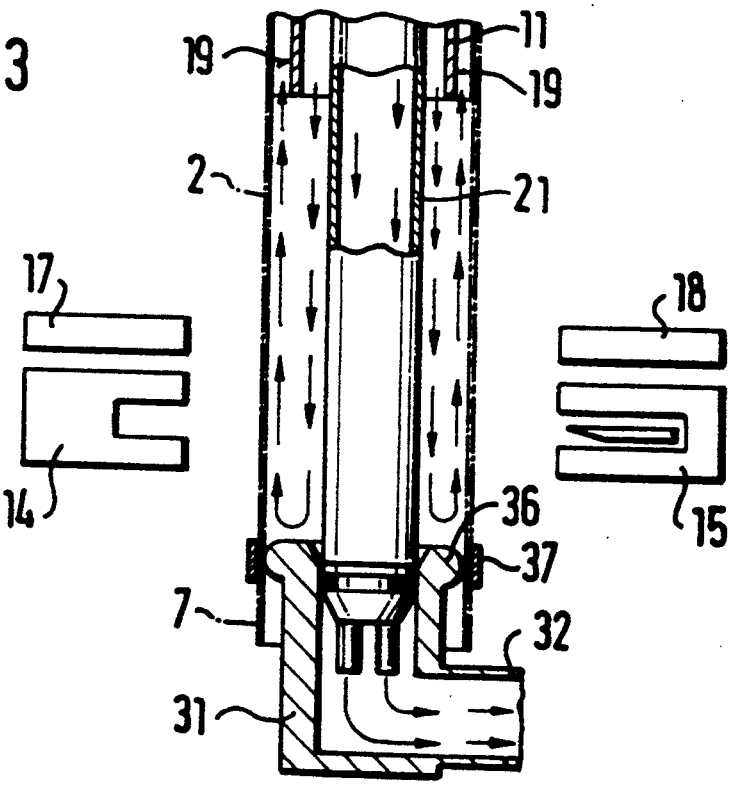

Before, during or after the application of the steam, the tube 2, which is open at the bottom, is drawn downward, and its end 7 is pulled over the edge of the opening of the cup 31, which is embodied as a bead 36. By the intrinsic tension of the tube 2 or by placing a tension ring 37 around it, the tube 2 is tightly joined to the cup 31, so that the interior of the tue is completely sealed off from the surroundings (FIG. 3). A sterilizing agent, such as atomized hydrogen peroxide or hydrogen peroxide suspended in steam, is introduced into the interior between the outer wall of the filling tube 21 and the inside of the tube 2 and of the forming tube 11, through the upper end of the forming tube 11; the sterilizing agent also gets into the gap between the tube 2 and the forming tube 11 through longitudinal grooves 19 on the outside of the forming tube 11 in its extension, and has a sterilizing effect.

Figure 4:
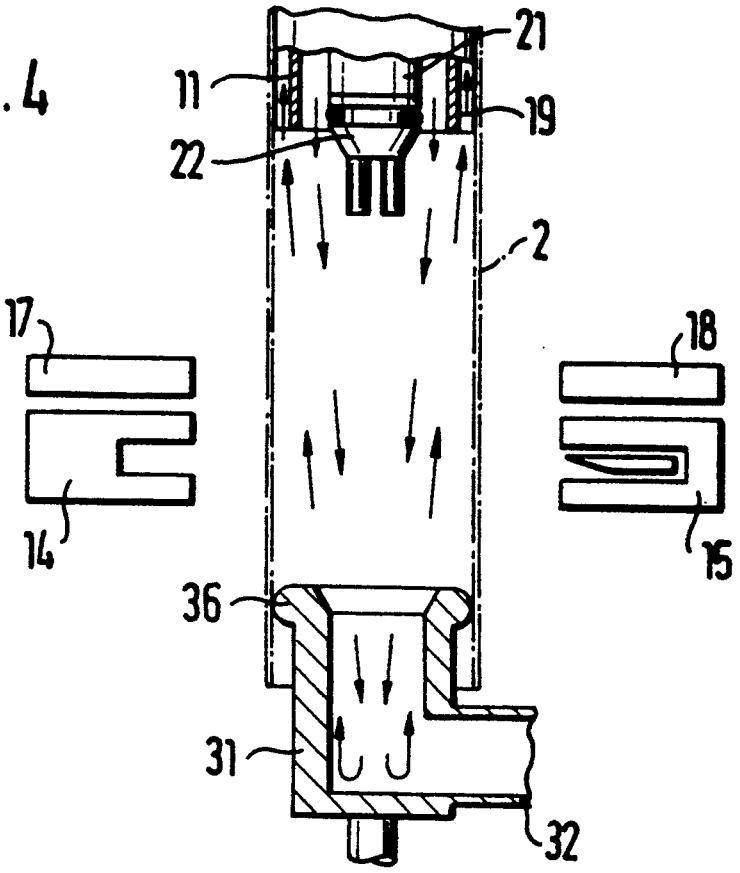
Figure 5:
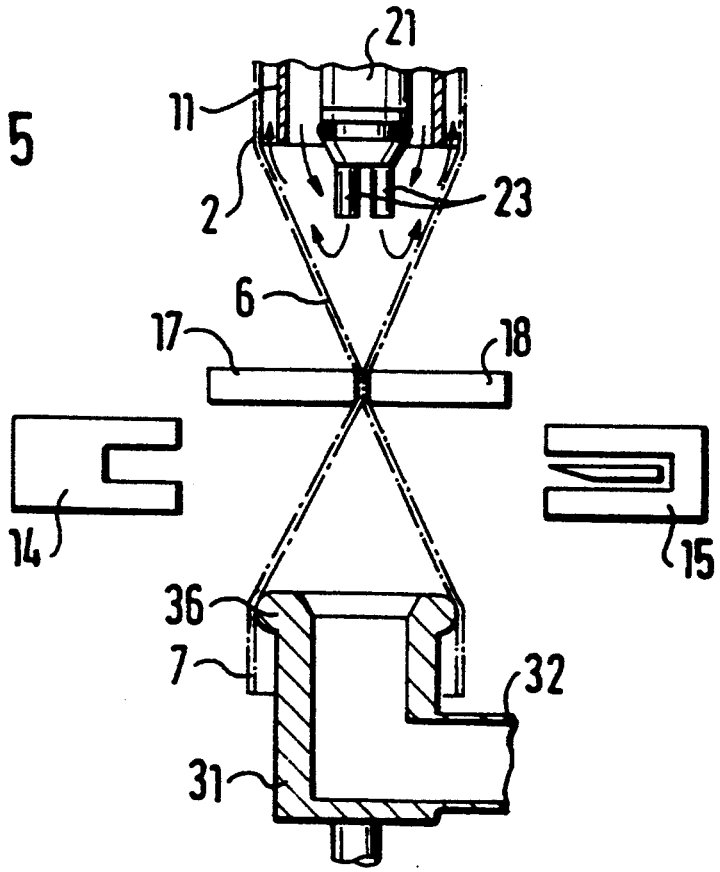

After a certain period of time, the steam feed is switched off, and the filling tube 21 is moved by the cylinder 24 to its upper position (FIG. 4). The clamping jaws 17, 18 and/or the sealing jaws 14, 15 are then pressed together, so that between the filling tube 21 and the cup 31, they seal the tube 2 by pressing it flat (FIG. 5). In this position, if the feed of sterilizing agent into the forming tube 11 continues, the outer portion of the filling tube 21 and filling head 22 that was previously covered by the cup 31 is also acted upon by sterilizing agent.

Figure 6:
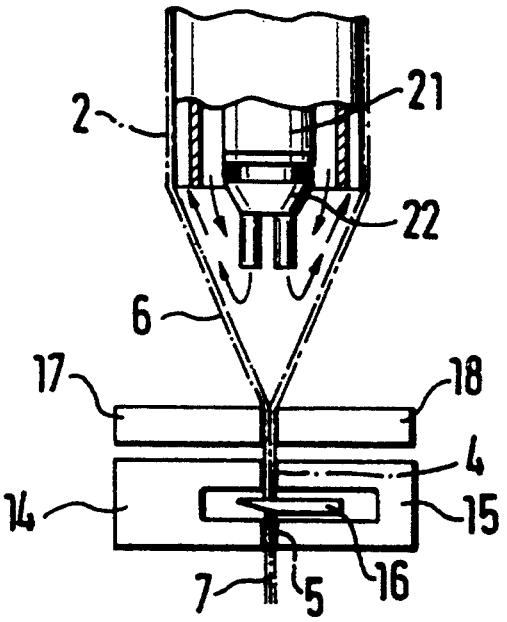

Finally, the cup 31 is removed from the end 7 of the tube by being lowered and is swiveled into the position of repose. The machine is then put into operation, and for the time being sterilizing agent continues to be fed, rather than the filling product, and approximately 20 bag packages filled with sterilizing agent are produced. The feed of sterilizing agent into the forming tube 11 is then discontinued, and a sterile gas or sterile air is fed instead. The sealing jaws 14, 15 move toward one another, provide the tube 2, under the clamping jaws 17, 18, with a bottom and top seam 4 and 5, respectively (FIG. 6), and pull the tube 2 downward by the length of one bag. After the tube has been indexed forward by a few increments without any product having been introduced through the filling tube 21 into the end portions 6 of the tube 2, the machine is ready to perform filling. Production is begun by feeding the sterile liquid product through the filling tube 21. It should be noted that the sheet 1 of packaging material is naturally rendered germ-free before being formed into a tube 2, and the forming and filling apparatus are housed in a room that has a sterile atmosphere.

The foregoing relates to a preferred exemplary embodiment of the invention, it being understood that other variants and embodiments thereof are possible within the spirit and scope of the invention, the latter being defined by the appended claims.

What is claimed and desired to be secured by Letters patent of the United States is:

1. A method for sterilizing parts of a packaging machine of the type in which a tube of packaging material is formed, a product intended for filling packages is introduced through a filling tube into an opening towards a sealed-off end portion of the tube, the tube is advanced, and the filled end portion is sealed off and cut off by a sealing and cutting device, before the machine is put into operation and before changing to a different packaging material a sterilizing agent is passed through the filling tube of the packaging machine, which comprises connecting the outlet end of the filling tube to a connecting element which includes a drain, advancing the packaging material tube to below the connection of the outlet end of said filling tube to said connecting element, securing the packaging material tube about the connection element, passing a sterilizing agent through said filling tube, said connection element and said drain; subsequent to sterilizing the filling tube, the filling tube is withdrawn from the connecting element to a position above the sealing and cut-off device, sealing the packaging material tube by the sealing device and cutting the sealed packaging material tube to provide a closed end, whereby the closed end of the packaging material tube maintains a sterile condition with the filling tube.

2. A method of claim 1, in which the end (7) of the packaging material tube (2) is slipped onto the connecting element (31) to tightly surround it.

3. A method as defined by claim 1, in which the end (7) of the packaging material tube (2) is clamped firmly and tightly to the connecting element (31) with a tension ring (37).

4. An apparatus for filling a material into a packaging material tube and for sterilizing a packaging machine having a filling tube along which a packaging material is advanced incrementally to form a packaging material tube, a transverse sealing device for partitioning off each end portion of the formed packaging material tube, and a movable connecting element that includes a drain, the movable connecting element (31) is embodied in the form of a cup for tightly receiving the filling tube end (22), and the drain (33) is connected to the connecting element (31); and that the filling tube (21) and the connecting element (31) are displaceable relative to one another, so that in a position where the filling tube and connecting element are moved apart from one another, the end portion of the tube (2), whose end (7) rests tightly on the connecting element (31), is located in the working range of the transverse sealing device (14, 15).

5. An apparatus as defined by claim 4, in which the connecting element is embodied in the form of a cup (31) and has an opening (32) to the drain (33).

6. An apparatus as defined by claim 4, in which the connecting element (31), on its open end, has an encompassing bead (36) so that the packaging material tube (2) can be spread over it and secured by a tension ring.

7. An apparatus as defined by claim 5, in which the connecting element (31), on its open end, has an encompassing bead (36) so that the packaging material tube (2) can be spread over it and secured by a tension ring.

* * * * *